US011313331B2

(12) United States Patent
Sato et al.

(10) Patent No.: US 11,313,331 B2
(45) Date of Patent: Apr. 26, 2022

(54) INTAKE DEVICE FOR INTERNAL COMBUSTION ENGINE

(71) Applicants: HONDA MOTOR CO., LTD., Tokyo (JP); Tigers Polymer Corporation, Osaka (JP)

(72) Inventors: Takashi Sato, Wako (JP); Akihito Saka, Kobe (JP); Jun Hatakeyama, Kobe (JP)

(73) Assignee: HONDA MOTOR CO., LTD., Tokyo (JP)

( * ) Notice: Subject to any disclaimer, the term of this patent is extended or adjusted under 35 U.S.C. 154(b) by 211 days.

(21) Appl. No.: 16/598,005

(22) Filed: Oct. 10, 2019

(65) Prior Publication Data

US 2020/0116111 A1 Apr. 16, 2020

(30) Foreign Application Priority Data

Oct. 15, 2018 (JP) ..... JP2018-194005

(51) Int. Cl.

| | |
|---|---|
| ***F02M 35/024*** | (2006.01) |
| ***F02M 35/14*** | (2006.01) |
| *F02M 35/04* | (2006.01) |
| *F02M 35/02* | (2006.01) |

(52) U.S. Cl.

CPC ..... *F02M 35/02433* (2013.01); *F02M 35/02491* (2013.01); *F02M 35/14* (2013.01); *F02M 35/0203* (2013.01); *F02M 35/044* (2013.01)

(58) Field of Classification Search

CPC ..... F02M 35/02433; F02M 35/02491; F02M 35/14; F02M 35/0203; F02M 35/044

USPC ..... 55/495

See application file for complete search history.

(56) References Cited

U.S. PATENT DOCUMENTS

2003/0221562 A1* 12/2003 Bloomer ..... F02M 35/02483 96/384

FOREIGN PATENT DOCUMENTS

| | | | | |
|---|---|---|---|---|
| JP | H0730358 | U | | 6/1995 |
| JP | 2004176639 | A | * | 6/2004 |
| JP | 2004176639 | A | | 6/2004 |
| JP | 3648365 | B2 | | 5/2005 |
| JP | 4254349 | B2 | | 4/2009 |
| JP | 2018009558 | A | * | 1/2018 |
| JP | 2018009558 | A | | 1/2018 |

OTHER PUBLICATIONS

JPO Notice of Reasons for Refusal for Japanese Patent Application No. 2018-194005 drafted Jul. 15, 2020; 6 pp.

* cited by examiner

*Primary Examiner* — T. Bennett McKenzie
*Assistant Examiner* — Qianping He
(74) *Attorney, Agent, or Firm* — Armstrong Teasdale LLP

(57) ABSTRACT

In an intake device for an internal combustion engine, a first resonator chamber (61) is defined between a clean side chamber (56) and a peripheral wall (8) of a case (2), and a first communication passage (61B) communicating a dust side chamber (55) with the first resonator chamber is extending along the peripheral wall of the case.

12 Claims, 5 Drawing Sheets

INTAKE DEVICE FOR INTERNAL COMBUSTION ENGINE

TECHNICAL FIELD

The present invention relates to an intake device for an internal combustion engine.

BACKGROUND ART

Known intake devices for an internal combustion engine often integrally combine an air cleaner and a resonator (muffler) into a single unit. See JP3648365B2 and JP4254349B2, for instance. By forming the air cleaner and the resonator as a single compact unit, the overall size of the intake device can be minimized.

The natural frequency of a resonator consisting of a Helmholtz resonator is determined by the volume of the chamber (cavity, resonator chamber), the length of the inlet passage (neck, communication passage) of the chamber, and the opening area of the inlet passage. In order to lower the natural frequency, it is necessary to increase the volume of the chamber, and/or increase the length of the inlet passage. However, when the chamber is enlarged and/or the inlet passage is extended, the size of the intake device inevitably increases.

SUMMARY OF THE INVENTION

In view of such a problem of the prior art, a primary object of the present invention is to provide an intake device incorporated with a resonator having an adequately low natural frequency without unduly increasing the size of the intake device.

To achieve such an object, one embodiment of the present invention provides an intake device (1) for an internal combustion engine, comprising: a case (2) internally defining a dust side chamber (55), a clean side chamber (56), and a first resonator chamber (61A); and a filter element (45) provided between the dust side chamber and the clean side chamber, wherein the first resonator chamber is defined between a peripheral wall (8) of the case and one of the dust side chamber and the clean side chamber, the first resonator chamber communicating with another of the dust side chamber and the clean side chamber via a first communication passage (61B) extending along the peripheral wall of the case.

Thereby, the first resonator chamber, the first communication passage, the dust side chamber, and the clean side chamber can be efficiently arranged in the intake device, and the first communication passage can be extended in length without increasing the size of the intake device. As a result, the natural frequency of the first resonator can be lowered without unduly increasing the size of the intake device.

Preferably, the first resonator chamber is defined along a part of the peripheral wall on a first side of the case with respect to a first direction, and the other of the dust side chamber and the clean side chamber extends along a part of the peripheral wall on a second side of the case which is diametrically opposed to the first side with respect to the first direction, the first communication passage extending in the first direction.

Thereby, the distance between the first resonator chamber and other of the dust side chamber and clean side chamber with which the first resonator chamber is communicated can be maximized, and the length of the first communication passage can be maximized for the given size of the case.

Preferably, the case further defines a second resonator chamber (62A) communicating with the one of the dust side chamber and the clean side chamber via a second communication passage (62B) in such a manner that the first communication passage is defined between the peripheral wall and a part of a wall defining the second resonator chamber.

By thus positioning the second resonator chamber so as to define the first communication passage leading to the first resonator chamber in cooperation with the peripheral wall, the length of the first communication passage can be maximized for the given size of the case.

Preferably, the filter element is provided with a plate shape having a hypothetical plane (S1) passing centrally through the filter element and extending in parallel with the first direction such that air flows from the dust side chamber to the clean side chamber across the hypothetical plane.

Thereby, the filter element which may have a relatively large surface area can be conveniently received in the case having a limited height.

Preferably, the first communication passage extends along a part of the peripheral wall on a first side of the case with respect to a second direction extending in parallel with the hypothetical plane and orthogonal to the first direction, and an intake inlet (51) communicating with the dust side chamber and an intake outlet (52) communicating with the clean side chamber are provided in a part of the peripheral wall on a second side of the case diametrically opposed to the first side with respect to the second direction.

By thus positioning the inlet of the first communication passage remote from the intake inlet and the intake outlet, even when the first communication passage is connected to the dust side chamber, the foreign matters contained in the intake air or a blowback from the intake device are prevented from entering the first communication passage.

Preferably, the hypothetical plane extends through the first resonator chamber and the clean side chamber.

Thereby, the first resonator chamber and the clean side chamber can be positioned one next to the other so that the available inner space of the case can be optimally utilized.

Preferably, the case includes a lower case member (3) having a bottom plate (7) and a side wall (8) extending upright from a peripheral part of the bottom plate, the side wall forming at least a part of the peripheral wall of the case, an upper case member (4) substantially conformal to the lower case member in plan view and having an upper plate (31) and a recess bottom plate (35) connected to the upper plate via a vertical wall part (39) such that the recess bottom plate is recessed downward with respect to the upper plate, and a cover (5) extending in continuation with the upper plate and opposing the recess bottom plate from above, and wherein the dust side chamber is defined between the bottom plate and the recess bottom plate, the clean side chamber is defined between the cover and the recess bottom plate and between the upper plate and the bottom plate, and the first resonator chamber is defined between the upper plate and the bottom plate.

Thus, the hollow interior of the case includes a first part which is vertically separated into the dust side chamber and an upstream part of the clean side chamber, and a second part which is laterally separated into a downstream part of the clean side chamber and the first resonator chamber which extend over the entire height of the case. Thereby, the volume of the clean side chamber and the first resonator chamber can be maximized for the given size or the given height of the case.

Preferably, the recess bottom plate is provided with a first opening (41) configured to be fitted with the filter element, and the vertical wall part is provided with a second opening (38) communicating an upstream part of the clean side chamber defined between the cover and the recess bottom plate with a downstream part of the clean side chamber defined between the upper plate and the bottom plate.

Thereby, the flow of air in the hollow interior of the case can be efficiently organized.

Preferably, the vertical wall part comprises a plurality of slats (39) extending across the second opening between the upper plate and the recess bottom plate.

Thereby, the case can be reinforced against a vertical load that may be applied to the upper plate while ensuring a large cross sectional area to the second opening.

Preferably, the first resonator chamber is defined by the peripheral wall of the case and a wall part defining the downstream part of the clean side chamber.

Thereby, the first resonator chamber can be given with a large volume without interfering with the layout of the clean side chamber.

Preferably, the case further includes a second resonator chamber (62A) communicating with the downstream part of the clean side chamber, and the first communication passage is defined by a wall part defining the second resonator chamber and the peripheral wall.

By thus positioning the second resonator chamber so as to define the first communication passage leading to the first resonator chamber in cooperation with the peripheral wall, the length of the first communication passage can be maximized for the given size of the case.

Preferably, the second resonator chamber is further defined by a wall part defining the dust side chamber and the upstream part of the clean side chamber.

Thus, the second resonator may be given with a relatively large volume.

Preferably, the case is substantially rectangular in shape in plan view, and more preferably, the recess bottom plate is substantially in parallel with the bottom plate, and a vertical distance between the cover and the recess bottom plate decreases as one moves away from the second opening.

Thereby, the intake device may be unobtrusively positioned in a limited space of the vehicle such as a space between the engine head cover and the engine hood.

The present invention thus provides an intake device incorporated with a resonator having an adequately low natural frequency without unduly increasing the size of the intake device.

DESCRIPTION OF THE PREFERRED EMBODIMENT(S)

An embodiment of an intake device 1 according to an embodiment of the present invention is described in the following with reference to the appended drawings. The intake device 1 is provided in an intake system of an internal combustion engine of an automobile, and functions as an air cleaner with noise reducing features. In the following description, the various directions will be based on the attitude of the intake device 1 as mounted on the vehicle. However, the present invention is not limited by the particular attitude or the orientation of the intake device 1 of the illustrated embodiment.

Figure 1:
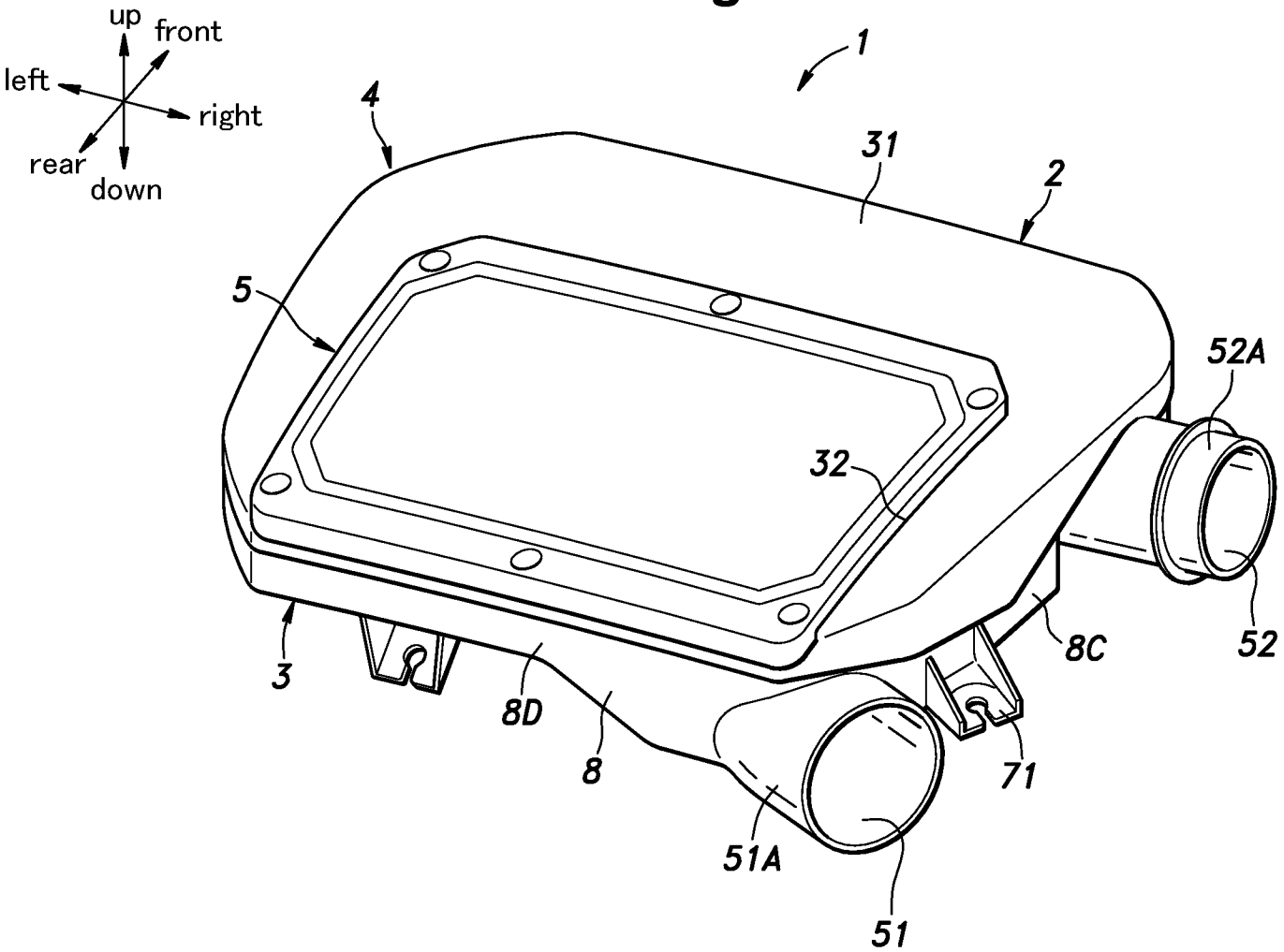
FIG. 1 is a perspective view of an intake device according to an embodiment of the present invention.

As shown in FIG. 1, the intake device 1 is provided with a case 2 that forms an outer shell. The case 2 includes a lower case member 3, an upper case member 4, and a lid 5. The lower case member 3, the upper case member 4, and the lid 5 are all made of injection molded resin material.

Figure 2:
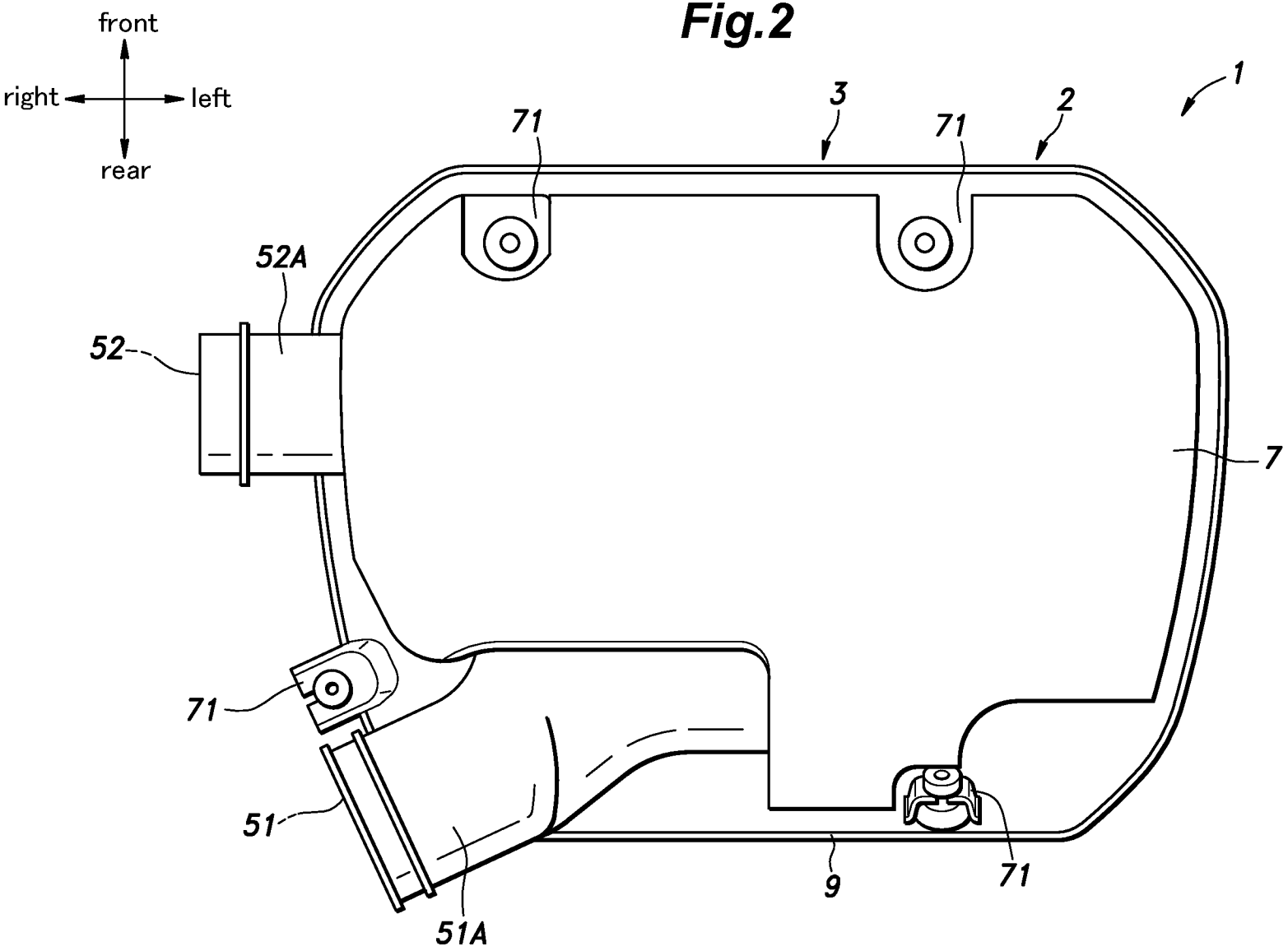
FIG. 2 is a bottom view of the intake device.
Figure 3:
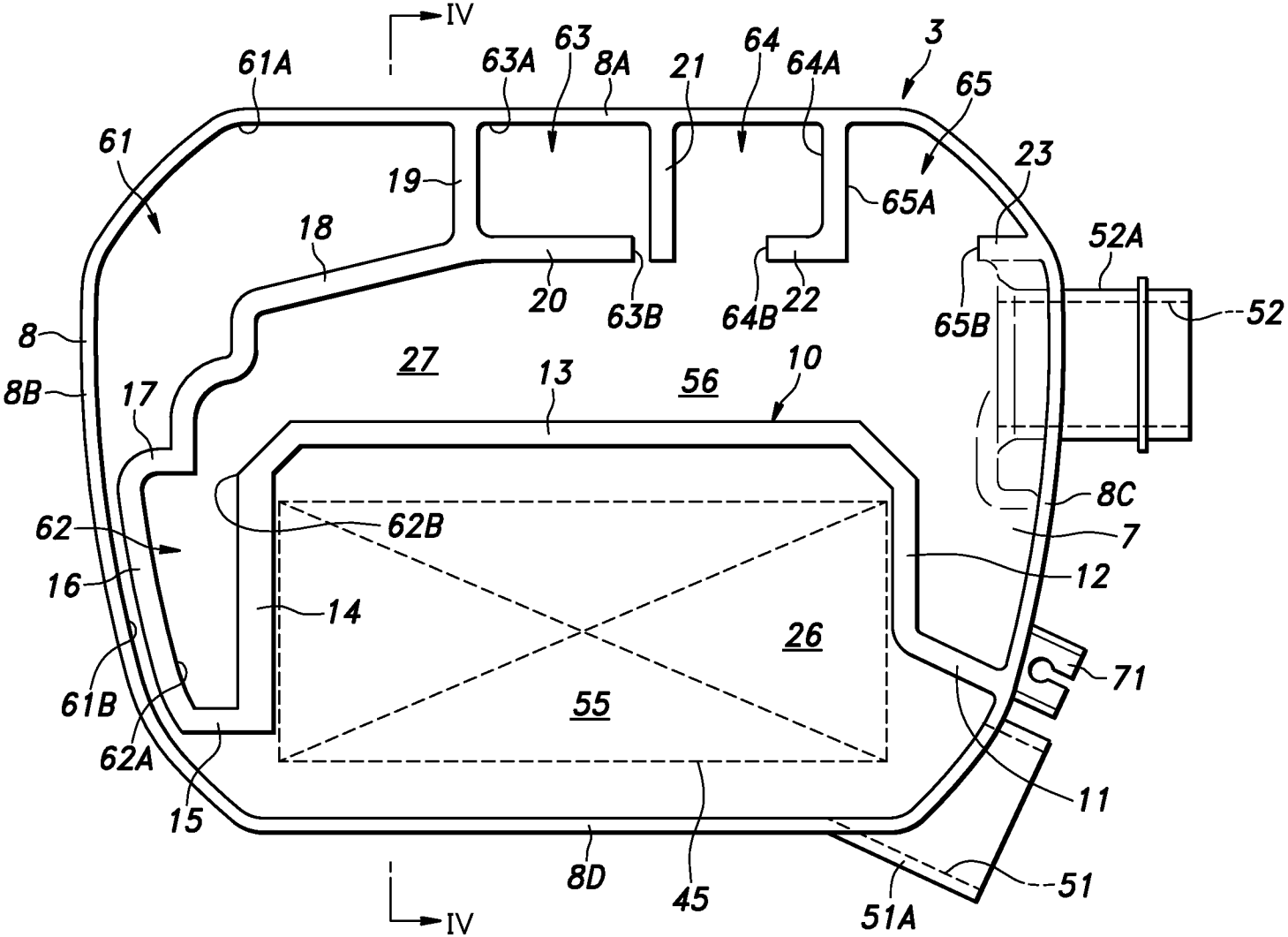
FIG. 3 is a plan view of a lower case member of the air intake device.

As shown in FIGS. 2 and 3, the lower case member 3 has a bottom plate 7 facing vertically, and a side wall 8 extending upright from the periphery of the bottom plate 7, and has an open upper side. The bottom plate 7 is substantially rectangular in shape, and is more elongated in the lateral direction (second direction) than in the fore and aft (first direction). The side wall 8 includes a front side wall 8A extending laterally along the front edge of the bottom plate 7, a left side wall 8B and a right side wall 8C extending in the fore and aft direction along the left and right side edges of the bottom plate 7, respectively, and the rear side wall 8D extending laterally along the rear edge of the bottom plate 7. The front side wall 8A, the left side wall 8B, the rear side wall 8D, and the right side wall 8C are continuous with each other, and form an annular shape. An outwardly extending annular lower flange 9 is formed at the upper end of the side wall 8 including the front side wall 8A, the left side wall 8B, the rear side wall 8D, and the right side wall 8C.

From the upper surface of the bottom plate 7 projects upward a partition wall 10 that includes a first wall portion 11 extending leftward from the inner surface of the right side wall 8C, second wall portion 12 extending forward from the left end of the first wall portion 11, a third wall portion 13 extending leftward from the front end of the second wall portion 12, a fourth wall portion 14 extending rearward from the left end of the third wall portion 13, a fifth wall portion 15 extending leftward from the rear end of the fourth wall portion 14, a sixth wall portion 16 extending forward from the left end of the fifth wall portion 15, a seventh wall portion 17 extending rightward from the front end of the sixth wall portion 16, an eighth wall portion 18 extending forward and rightward from the right end of the seventh wall portion 17, a ninth wall portion 19 extending forward from the front end of the eighth wall portion 18 and connected to the front side wall 8A, a tenth wall portion 20 extending rightward from the rear end of the ninth wall portion 19, an eleventh wall portion 21 extending rearward from a part of the front side wall 8A displaced to the right from the junction between the front side wall 8A and the ninth wall portion 19, a twelfth wall portion 22 extending rearward from a part of the front side wall 8A displaced to the right from the junction between the front side wall 8A and the eleventh wall portion 21 and bent leftward in a rear end part thereof, and a thirteenth wall portion 23 extending leftward from a part of the right side wall 8C displaced forward from the junction between the first wall portion 11 and the right side wall 8C.

The right end of the tenth wall portion 20 is laterally spaced from the rear end of the eleventh wall portion 21 with a small gap. The left end of the twelfth wall portion 22 is laterally spaced from the rear end of the eleventh wall portion 21 with a somewhat greater gap. The left end of the thirteenth wall portion 23 is spaced from the rear end of the twelfth wall portion 22 with an even greater gap.

Figure 4:
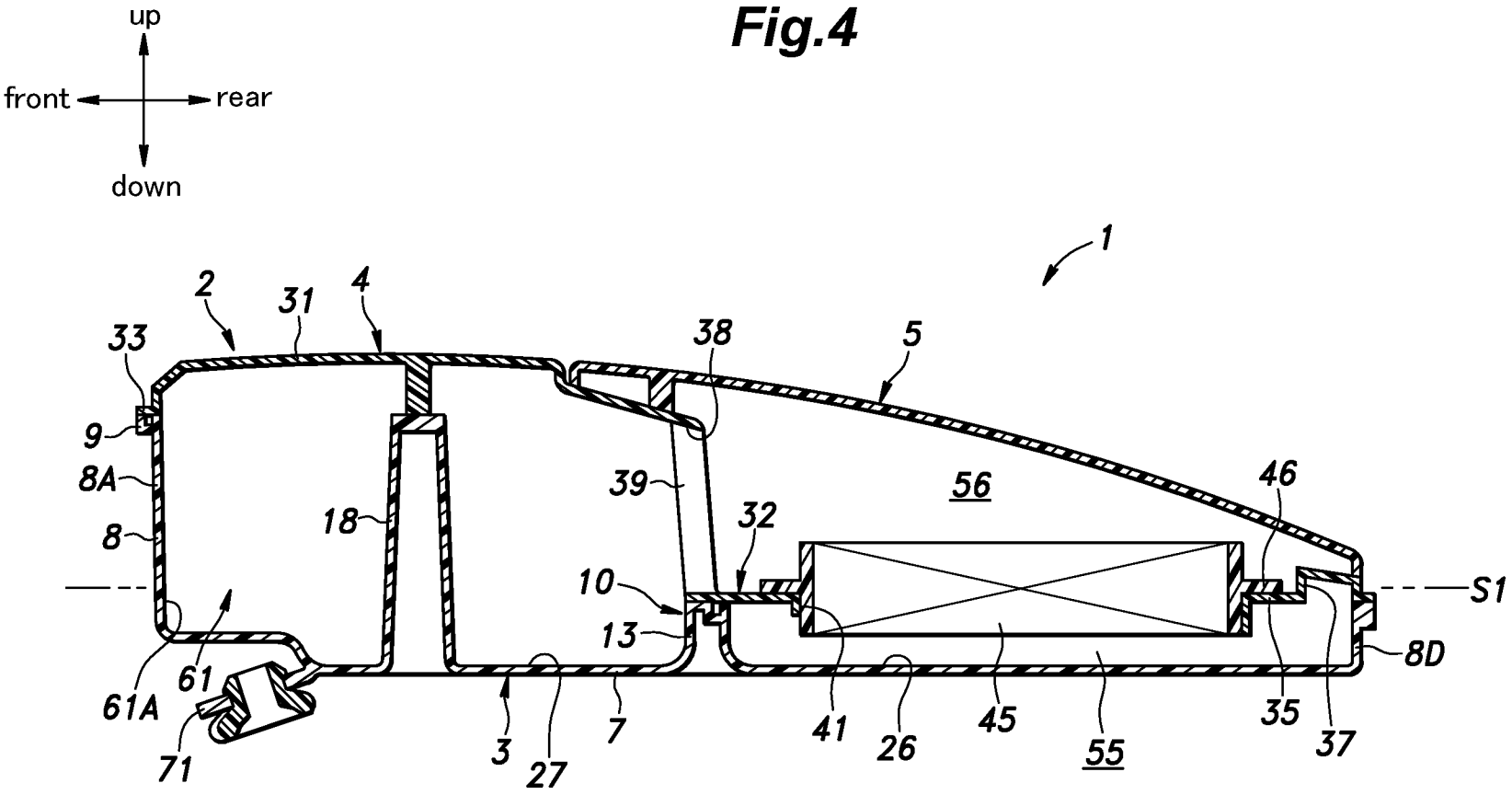
FIG. 4 is a sectional view taken along line IV-IV in FIG. 3.
Figure 5:
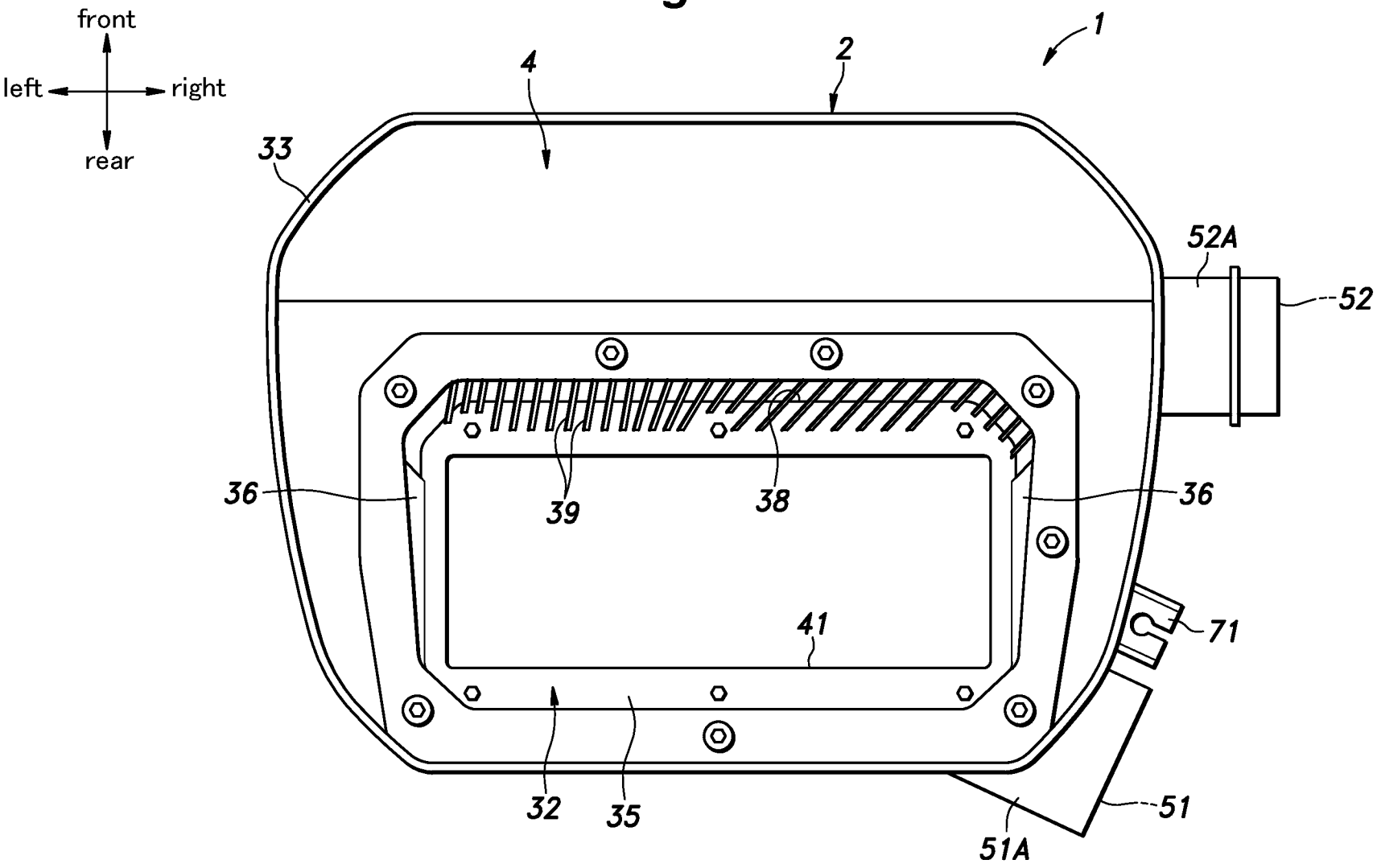
FIG. 5 is a plan view of the intake device with a filter element omitted from illustration.

As shown in FIGS. 4 and 5, the upper case member 4 includes an upper plate 31 which is inclined downward toward the rear, and provided with a rectangular opening, a pair of recess side walls 36 extending downward from the part of the upper plate 31 defining the lateral edges of the rectangular opening, respectively, a recess rear wall 37 extending downward from the part of the upper plate 31 defining the rear edge of the rectangular opening, and a recess bottom plate 35 connected to the lower edges of the recess side walls 36 and the recess rear wall 37.

Thus, a recess 32 that is recessed downward with respect to the upper plate 31 is defined by the recess bottom plate 35, the recess side walls 36, and the recess rear wall 37. The recess bottom plate 35 extends in parallel with the bottom plate 7 when the upper case member 4 is joined with the lower case member 3.

When the intake device 1 is mounted on the vehicle, the bottom plate 7 is slanted downward toward the front end thereof so that the upper plate 31 extends along a substantially horizontal contour of the engine hood. The vertical distance between the recess bottom plate 35 and the upper plate 31 is thus greater on the front side than on the rear side. The recess rear wall 37 is formed continuously with the recess side walls 36.

A first opening 41 (a passage or an opening extending in the vertical direction) is formed centrally in the recess bottom plate 35. A second opening 38 (a passage or an opening extending in the fore and aft direction) is formed between the front edge of the recess bottom plate 35 and the upper plate 31. The front edge of the recess bottom plate 35 is connected to the upper plate 31 by a plurality of vertical slats 39 extending vertically. The vertical slats 39 are laterally spaced apart from each other, and extend vertically across the second opening 38. Slots are thus formed between the vertical slats 39.

As will be described later, the lid 5 is provided so as to cover the recess 32, and the upper plate 31 and the lid 5 are arranged so as to present a substantially continuous upper surface. An annular upper flange 33 extends outward from the outer peripheral edge of the upper plate 31. The lower surface of the upper flange 33 is placed onto and attached to the upper surface of the lower flange 9 of the lower case member 3. The upper flange 33 and the lower flange 9 are preferably joined to each other by welding, for example.

The upper ends of the first to thirteenth wall portions 11 to 23 are connected to the lower surface of the upper case member 4. More specifically, the first wall portion 11 and the fifth to thirteenth wall portions 15 to 23 are connected to the lower surface of the upper plate 31 of the upper case member 4, and the second to fourth wall portions 12 to 14 are connected to the bottom surface of on the recess bottom plate 35. The second wall portion 12 is connected to the right edge of the bottom surface of the recess bottom plate 35, the third wall portion 13 is connected to the front edge (the part thereof ahead of the first opening 41) of the bottom surface of the recess bottom plate 35, and the fourth wall portion 14 is connected to the left edge of the lower surface of the recess bottom plate 35. The first wall portion 11 is connected to the upper plate 31, and is also connected to the right recess side wall 36. The fifth wall portion 15 is connected to the upper plate 31, and is also connected to the left recess side wall 36.

The hollow interior of the case 2 may be considered as consisting of two parts 26 and 27. The first part 26 is the part of the hollow interior coinciding with the recess bottom plate 35 in plan view, and the second part 27 corresponds to the remaining part of the hollow interior. The first part 26 is thus vertically separated into two chambers by the recess bottom plate 35. The part of the first part 26 under the recess bottom plate 35 defines a dust side chamber 55. The part of the first part 26 above the recess bottom plate 35 corresponds to an upstream part of a clean side chamber 56. The second part 27 consist of the part of the hollow interior other than the first part 26. The remaining part of the clean side chamber 56 or a downstream part of the clean side chamber 56 is included in the second part 27.

The second part 27 extends over the entire height of the case 2 whereas the first part 26 is separated into the dust side chamber 55 and the clean side chamber 56 by the recess bottom plate 35. Correspondingly, the second to fourth wall portions 12 to 14 are relatively small in height so as to delimit the dust side chamber 55 from three sides, and the remaining wall portions or the first wall portion 11 and the fifth to thirteenth wall portions 15 to 23 are relatively great in height so as to delimit the part of the clean side chamber 56 in the second part 27. Thus, the clean side chamber 56 includes the part located in the first part 26 of the hollow interior of the case 2 (or above the recess bottom plate 35), and having a relatively small height, and the part located in the second part 27 of the hollow interior of the case 2 (or in the remaining part of the hollow interior of the case 2).

As shown in FIG. 4, the dust side chamber 55 communicates with the recess 32 (the part of the clean side chamber 56 in the first part 25) via the first opening 41. The recess 32 communicates with the part of the clean side chamber 56 in the second part 27 via the second opening 38. The dust side chamber 55 does not directly communicate with the part of the clean side chamber 56 in the second part 27.

A filter element 45 is placed in the first opening 41. The filter element 45 is formed in a flat plate shape, and allows air to pass in a direction perpendicular to the major plane thereof. The filter element 45 may be, for example, a paper filter that filters dust (foreign matters) in the air. A substantially rectangular frame 46 is provided along the edge of the filter element 45. The frame 46 is attached to the peripheral edge portion of the first opening 41 on the upper surface of the recess bottom plate 35. The frame 46 may be fastened to the upper surface of the recess bottom plate 35 by screws, for example, so as to be detachable. The filter element 45 and the frame 46 cover the entire area of the first opening 41. The filter element 45 is attached to the recess bottom plate 35 so as to have a vertically facing surface. The filter element 45 extends in parallel with the bottom plate 7. In a state where the filter element 45 is attached to the recess bottom plate 35, a hypothetical plane S1 passing centrally through the filter element 45 with respect to the thickness-wise direction thereof extends in parallel with the bottom plate 7.

The upper side of the recess 32 is covered by the lid 5 which is detachably fastened to the peripheral edge portion of the upper surface of the upper plate 31 surrounding the recess 32 with screws. A seal member may be provided between the peripheral edge portion of the lower surface of the lid 5 and the opposing surface of the upper plate 31. The filter element 45 can be replaced by opening the lid 5.

As shown in FIGS. 1 and 3, a rear part of the right side wall 8C behind the part where the first wall portion 11 is connected to the right side wall 8C is provided with an intake inlet 51 communicating with the dust side chamber 55. The intake inlet 51 is formed as a pipe 51A protruding from the right side wall 8C. The pipe 51A of the intake inlet 51 is connected via a duct (not shown in the drawings) to an air inlet via which the ambient air is drawn. A front part of the right side wall 8C which is located ahead the part where the first wall portion 11 is connected to the right side wall 8C is provided with an intake outlet 52 communicating with the part of the clean side chamber 56 located in the second part 27 of the hollow interior of the case 2. The intake outlet 52 is formed as a pipe 52A protruding from the right side wall 8C. The pipe 52A of the intake outlet 52 is connected to the intake ports of the engine via a duct, a throttle valve, an intake manifold, and the like which are not shown in the drawings.

The intake air flows from the intake inlet 51 through the dust side chamber 55, the filter element 45, and the clean side chamber 56, in that order, before reaching the intake outlet 52. Thus the second opening 38 is a communication passage positioned between the upstream part and the downstream part of the clean side chamber 56, and the first opening 41 is a communication passage positioned between the dust side chamber 55 and the clean side chamber 56.

The dust side chamber 55 is a space communicating the intake inlet 51 with the filter element 45 (first opening 41) in the first part 26. More specifically, the dust side chamber 55 is defined by the bottom plate 7 of the lower case member 3, the rear side wall 8D, the part of the right side wall 8C located on the rear side of the junction with the first wall portion 11, the first to fourth wall portions 11 to 14, the rear part of the upper plate 31 of the upper case member 4, and the recess bottom plate 35.

The upstream part of the clean side chamber 56 is defined by the recess bottom plate 35, the recess side walls 36, the recess rear wall 37, and by the lid 5 in the first part 26. The downstream part of the clean side chamber 56 communicates with the second opening 38 and the intake outlet 52 in the second part 27. More specifically, the downstream part of the clean side chamber 56 in the second part 27 is defined by the bottom plate 7, the first to third, eighth, tenth, twelfth, and thirteenth wall portions 11-13, 18, 20, 22 and 23, the part of the right side wall 8C located ahead of the junction with the first wall portion 11, and upper plate 31 of the upper case member 4.

As shown in FIG. 3, a first resonator chamber 61A is defined by the front side wall 8A, the left side wall 8B, the seventh to ninth wall portions 17 to 19, the bottom plate 7, and the upper plate 31. A first communication passage 61B is defined by the left side wall 8B, the sixth wall portion 16, the bottom plate 7, and the upper plate 31. The first resonator chamber 61A and the first communication passage 61B form a first resonator 61. The first resonator chamber 61A is formed between the front edge of the case 2 and the clean side chamber 56. In other words, the first resonator chamber 61A is provided in the front part of the case 2 which faces away from the rear edge part of the case 2 where the dust side chamber 55 is provided with respect to the fore and aft direction (first direction). The first resonator chamber 61A may also be provided so as to be spaced away from the dust side chamber 55, and the clean side chamber 56 and a part of other silencers may be interposed between the first resonator chamber 61A and the dust side chamber 55. The first communication passage 61B extends in the fore and aft direction along the left edge of the case 2, and communicates the first resonator chamber 61A with the dust side chamber 55 provided in the rear edge part of the case 2. The first resonator chamber 61A and the first communication passage 61B are provided on the left edge part of the case 2 facing away from the right edge part of the case 2 where the intake inlet 51 and the intake outlet 52 are provided with respect to the lateral direction (second direction).

A second resonator chamber 62A is defined by the fourth to seventh wall portions 14 to 17, the bottom plate 7, and the upper plate 31. The front end of the fourth wall portion 14 and the right end of the seventh wall portion 17 form a second communication passage 62B that communicates the second resonator chamber 62A with the clean side chamber 56. The second resonator chamber 62A and the second communication passage 62B form a second resonator 62. The second resonator chamber 62A adjoins the right side of the first communication passage 61B so as to form the first communication passage 61B jointly with the left edge part of the case 2. On the right side of the second resonator chamber 62A is the dust side chamber 55.

A third resonator chamber 63A is defined by the front side wall 8A, the ninth to eleventh wall portions 19 to 21, the bottom plate 7, and the upper plate 31. The right end of the tenth wall portion 20 and the rear end of the eleventh wall portion 21 form a third communication passage 63B that communicates the third resonator chamber 63A with the clean side chamber 56. The third resonator chamber 63A and the third communication passage 63B form a third resonator 63. The third resonator chamber 63A is provided along the front edge of the case 2, and is positioned on the right side of the first resonator chamber 61A.

A fourth resonator chamber 64A is defined by the front side wall 8A, the eleventh and twelfth wall portions 21 and 22, the bottom plate 7, and the upper plate 31. The rear end of the eleventh wall portion 21 and the left end of the twelfth wall portion 22 form a fourth communication passage 64B communicating the fourth resonator chamber 64A with the clean side chamber 56. The fourth resonator chamber 64A and the fourth communication passage 64B form a fourth resonator 64. The fourth resonator chamber 64A is provided along the front edge of the case 2 and is provided on the right side of the third resonator chamber 63A.

A fifth resonator chamber 65A is defined by the front side wall 8A, the right side wall 8C, the twelfth and thirteenth wall portions 22, 23, the bottom plate 7, and the upper plate 31. The bent portion (rear end) of the twelfth wall portion 22 and the left end of the thirteenth wall portion 23 form a fifth communication passage 65B that communicates the fifth resonator chamber 65A with the clean side chamber 56. The fifth resonator chamber 65A and the fifth communication passage 65B form a fifth resonator 65. The fifth resonator chamber 65A is provided along the front edge of the case 2, and adjoins the fourth resonator chamber 64A on the right side thereof. The first and third to fifth resonator chambers 61A, 63A to 65A are arranged one next to the other, and arranged along the front edge of the clean side chamber 56 (case 2).

The first to fifth resonators 61 to 65 are formed as Helmholtz resonators, and can be tuned so as to reduce the noises of selected frequency ranges as well known in the art. The natural frequencies of the first to fifth resonators 61 to 65 can be expressed by the following equation, and are each determined by the volume of the corresponding resonator chamber 61A to 65A (cavities), the length of the communication passage 61B to 65B (neck), and the opening area of the communication passage:

$$\omega 0 = c \times \sqrt{(S/VL)}$$

where ω0 is the natural frequency [Hz] of the resonator, c is the speed of sound [m/s], S is the opening area [$m^2$] of the communication passage, L is the length [m] of the communication passage, and V is the volume of the resonator chamber [$m^3$].

The first to fifth resonator chambers 61A to 65A are arranged on the front side and the left side of the filter element 45. The hypothetical plane S1 passing through the filter element 45 extends through the first to fifth resonator chambers 61A to 65A. In addition, the hypothetical plane S1 extends through the downstream part of the clean side chamber 56.

A plurality of attachment pieces 71 are provided at appropriate positions on the lower surface of the bottom plate 7 to fixedly secure the case 2 to the vehicle body or the internal combustion engine. The attachment pieces 71 may be secured to the vehicle body or the like by using screws or other fasteners via a cushioning (elastic) member such as a rubber bush. The case 2 may be attached to the upper part of the head cover of the engine, for example.

In the intake device 1 of the illustrated embodiment, the resonators 61 to 65, the dust side chamber 55, and the clean side chamber 56 can be efficiently arranged, and without increasing the size of the intake device 1 while the natural frequencies of the resonators 61 to 65 can be set to desired values as required.

The first resonator chamber 61A of the first resonator 61 communicates with the dust side chamber 55 via the first communication passage 61B. The dust side chamber 55 is provided on the rear edge of the case 2, the first resonator chamber 61A is provided between the front side wall 8A of the case 2 and the clean side chamber 56, and the first communication passage 61B extends along the outer edge (left edge) of the case 2. Therefore, the length of the first communication passage 61B communicating the first resonator chamber 61A with the dust side chamber 55 can be maximized, and the natural frequency of the first resonator 61 can be lowered. Because the dust side chamber 55 is provided on the rear edge of the case 2, the first resonator chamber 61A is provided on the front edge of the case 2, and the first communication passage 61B extends in the fore and aft direction, the length of the first communication passage 61B can be particularly elongated. In addition, since the second resonator chamber 62A and the clean side chamber 56 are disposed between the first resonator chamber 61A and the dust side chamber 55 with respect to the fore and aft direction, the length of the first communication passage 61B can be maximized while making full use of the available inner space of the case 2.

Further, since the first communication passage 61B extends along the left edge of the case 2, interference with the clean side chamber 56 and the other resonator chambers in the case 2 can be avoided. Thereby, the space available in the case 2 can be optimally utilized, and the necessary size of the intake device 1 can be minimized. In particular, the arrangement of the first resonator chamber 61A, the first communication passage 61B, and the second resonator chamber 62A can be optimized by disposing the second resonator chamber 62A to the right of the first communication passage 61B so that the size of the intake device 1 can be particularly minimized.

Since the intake inlet 51 and the intake outlet 52 are provided in the right side wall 8C, and the open end of the first communication passage 61B opening to the dust side chamber 55 is provided on the left edge of the case 2, the inlet of the first communication passage 61B is positioned relatively remotely from is the intake inlet 51 and the intake outlet 52 so that the foreign matter that may be contained in the intake air are prevented from entering the first communication passage 61B. Therefore, clogging of the first communication passage 61B can be prevented.

The hypothetical plane S1 passing through the filter element 45 extends through the first to fifth resonator chambers 61A to 65A, and the downstream part of the clean side chamber 56. In particular, by arranging the first to fifth resonator chambers 61A to 65A and the downstream part of the clean side chamber 56 in the second part 27 of the hollow interior of the case 2, the vertical dimension of the case 2 can be fully utilized, and the volumes of each of these chambers can be maximized for the given fore and aft, and lateral dimensions (the footprint) of the case 2. The part of the first part 26 located above the recess bottom plate 35 is utilized as the upstream part of the clean side chamber 56 so that the total volume of the clean side chamber 56 can be maximized for the given footprint of the case 2.

Since the first to fifth resonator chambers 61A to 65A, and the downstream part of the clean side chamber 56 are all arranged along the hypothetical plane S one next to another, the intake device 1 can be formed as a low profile device which is suited to be placed in a limited space between the upper surface of the engine and the lower surface of the engine hood. In addition, by positioning the open end of the first communication passage 61B facing the dust side chamber 55 on the side of the rear side wall 8D, and positioning the first resonator chamber 61 on the side of the front side wall 8A (or the corner part defined by the left side wall 8B and the front side wall 8A), the length of the first communication passage 61B can be maximized.

The present invention has been described in terms of a specific embodiment, but is not limited by such an embodiment, and can be modified in various ways without departing from the spirit of the present invention.

In the foregoing amendment, the first resonator chamber 61A was formed between the outer edge of the case 2 and the clean side chamber 56, and communicated with the dust side chamber 55 via the first communication passage 61B extending along the outer edge of the case 2. However, it may be also arranged such that the first resonator chamber 61A is defined between the dust side chamber 55 and the peripheral wall of the case, and the first resonator chamber 61A communicates with the clean side chamber 56 via the first communication passage 61B extending along the outer peripheral wall of the case.

The invention claimed is:

1. An intake device for an internal combustion engine, comprising a case internally defining a dust side chamber, a clean side chamber, and a first resonator chamber; and a filter element provided between the dust side chamber and the clean side chamber, wherein the first resonator chamber is defined between a peripheral wall of the case and one of the dust side chamber and the clean side chamber, the first resonator chamber communicating with another of the dust side chamber and the clean side chamber via a first communication passage extending along the peripheral wall of the case, wherein the first resonator chamber is defined along a part of the peripheral wall on a first side of the case with respect to a first direction, and the other of the dust side chamber and the clean side chamber extends along a part of the peripheral wall on a second side of the case which is diametrically opposed to the first side with respect to the first direction, the first communication passage extending in the first direction, wherein at least a portion of the one of the dust side chamber and the clean side chamber is located between the first resonator chamber and the other of the dust side chamber and the clean side chamber with respect to the first direction, wherein the case includes a lower case member having a bottom plate and a side wall extending upright from a peripheral part of the bottom plate, the side wall forming at least a part of the peripheral wall of the case, an upper case member conformal to the lower case member in plan view and having an upper plate and a recess bottom plate connected to the upper plate via a vertical wall part such that the recess bottom plate is recessed downward with respect to the upper plate, and a cover extending in continuation with the upper plate and opposing the recess bottom plate from above, and wherein the dust side chamber is defined between the bottom plate and the recess bottom plate, the clean side chamber is defined between the cover and the recess bottom plate and between the upper plate and the bottom plate, and the first resonator chamber is defined between the upper plate and the bottom plate.

2. The intake device according to claim 1, wherein the case further defines a second resonator chamber communicating with the one of the dust side chamber and the clean side chamber via a second communication passage in such a manner that the first communication passage is defined between the peripheral wall and a part of a wall defining the second resonator chamber.

3. The intake device according to claim 1, wherein the filter element is provided with a plate shape having a hypothetical plane passing centrally through the filter element and extending in parallel with the first direction such that air flows from the dust side chamber to the clean side chamber across the hypothetical plane.

4. The intake device according to claim 3, wherein the first communication passage extends along a part of the peripheral wall on a first side of the case with respect to a second direction extending in parallel with the hypothetical plane and orthogonal to the first direction, and an intake inlet communicating with the dust side chamber and an intake outlet communicating with the clean side chamber are provided in a part of the peripheral wall on a second side of the case diametrically opposed to the first side with respect to the second direction.

5. The intake device according to claim 3, wherein the hypothetical plane extends through the first resonator chamber and the clean side chamber.

6. The intake device according to claim 1, wherein the recess bottom plate is provided with a first opening fitted with the filter element, and the vertical wall part is provided with a second opening communicating an upstream part of the clean side chamber defined between the cover and the recess bottom plate with a downstream part of the clean side chamber defined between the upper plate and the bottom plate.

7. The intake device according to claim 6, wherein the vertical wall part comprises a plurality of slats extending across the second opening between the upper plate and the recess bottom plate.

8. The intake device according to claim 6, wherein the first resonator chamber is defined by the peripheral wall of the case and a wall part defining the downstream part of the clean side chamber.

9. The intake device according to claim 8, wherein the case further includes a second resonator chamber communicating with the downstream part of the clean side chamber, and the first communication passage is defined by a wall part defining the second resonator chamber and the peripheral wall.

10. The intake device according to claim 9, wherein the second resonator chamber is further defined by a wall part defining the dust side chamber and the upstream part of the clean side chamber.

11. The intake device according to claim 1, wherein the case is rectangular in shape in plan view.

12. The intake device according to claim 11, wherein the recess bottom plate is in parallel with the bottom plate, and a vertical distance between the cover and the recess bottom plate decreases as one moves away from the second opening.

* * * * *